US007380487B2

(12) United States Patent
Mantras

(10) Patent No.: US 7,380,487 B2
(45) Date of Patent: Jun. 3, 2008

(54) MAGNETOMECHANICAL SYSTEM FOR REDUCTION THE RECOIL OF A GUN

(76) Inventor: Dimitrios Mantras, 37 Mikras Asias str., Argiroupoli, Athens (GR)

( * ) Notice: Subject to any disclaimer, the term of this patent is extended or adjusted under 35 U.S.C. 154(b) by 0 days.

(21) Appl. No.: 10/522,271

(22) PCT Filed: Jun. 2, 2003

(86) PCT No.: PCT/GR04/00008

§ 371 (c)(1),
(2), (4) Date: Jan. 25, 2005

(87) PCT Pub. No.: WO2004/070306

PCT Pub. Date: Aug. 19, 2004

(65) Prior Publication Data

US 2006/0048637 A1 Mar. 9, 2006

(30) Foreign Application Priority Data

Feb. 6, 2003 (GR) ..... 030100056

(51) Int. Cl.
*F41A 25/00* (2006.01)

(52) U.S. Cl. ..... 89/42.01; 89/14.3; 42/1.06; 42/74

(58) Field of Classification Search ..... 42/1.06, 42/74; 89/14.3
See application file for complete search history.

(56) References Cited

U.S. PATENT DOCUMENTS

| | | | | |
|---|---|---|---|---|
| 1,877,839 | A * | 9/1932 | Frommer | 89/177 |
| 2,818,783 | A * | 1/1958 | Carlson et al. | 89/42.01 |
| 3,492,749 | A * | 2/1970 | Vironda | 42/74 |
| 4,201,113 | A * | 5/1980 | Seecamp | 89/199 |
| 4,369,759 | A * | 1/1983 | Gerstenberger et al. | 124/68 |
| 5,581,046 | A * | 12/1996 | Weldle et al. | 89/196 |
| 2002/0178901 | A1 * | 12/2002 | Bergstrom | 89/198 |

* cited by examiner

*Primary Examiner*—Michael J. Carone
*Assistant Examiner*—Gabriel J Klein
(74) *Attorney, Agent, or Firm*—Notaro & Michalos P.C.

(57) ABSTRACT

A recoil reduction mechanism for a gun includes two successive springs cooperating with a cylinder, an axle and a magnet. The magnet attracts the gun's slide and the cylinder, in a direction opposite of the slide's and the cylinder's recoil direction. A third spring, because of its position and size, acts as an extra suspension for the gun's recoil, and as an accelerator for the slide's reciprocating motion.

3 Claims, 2 Drawing Sheets

MAGNETOMECHANICAL SYSTEM FOR REDUCTION THE RECOIL OF A GUN

BACKGROUND OF THE INVENTION

A invention concerns a recoil mechanism for reducing the recoil of a gun. When a gun, as a mechanical system, is fired, the bullet travels along the gun's barrel and exits its muzzle. The resulting reactive force is imparted to the gun in the form of recoil. Apart from the gun's recoil phenomenon which is caused upon firing in the chamber because of the bullet's charge, the produced explosion gives to the gun's frame an instantaneous kinetic energy, annihilating any inertia phenomenon, which was prevailing in the reference system between the gun and the user before the explosion.

BACKGROUND ART

For the avoidance of the recoil phenomenon the current technology of portable guns like semi-automatic pistols, automatic pistols, submachine-guns and/or other heavy weaponry, the recoil systems use in most cases a recoil spring. Different technical solutions are used for the increase of the inertia of the reference system between the gun and the user, which nevertheless are restricted to small improvements in the present case, like:

1. By the addition of a mercury pouch on the gun's front end, so as to cause vertical resultant force, in order to increase the gun's inertia over the gun-barrel's recoil.
2. By gas escape from blow holes of the gun-barrel's top with a direction opposite of the gun's recoil direction upon shooting.

BRIEF SUMMARY OF THE INVENTION

The invention is a recoil mechanism for a gun that reduces the adverse effect of recoil. The invention is based on a magnet's presence, which in cooperation with successive springs, of the same or different diameter, of coil or wire type, controls the acceleration and the deceleration of the slide's reciprocating motion in a gun. Also by the mechanical only method, wherein one of the successive springs, having the same axial or another axial arrangement level and in succession with the mentioned successive springs, takes part in the motion, with a time lag. This happens because the ends of one of the springs do not abut from the beginning reference points in the gun, but only after the firing of each bullet. The result of all this function is the greatest possible control of the gun's recoil.

DETAILED DESCRIPTION OF THE INVENTION

Figure 1:
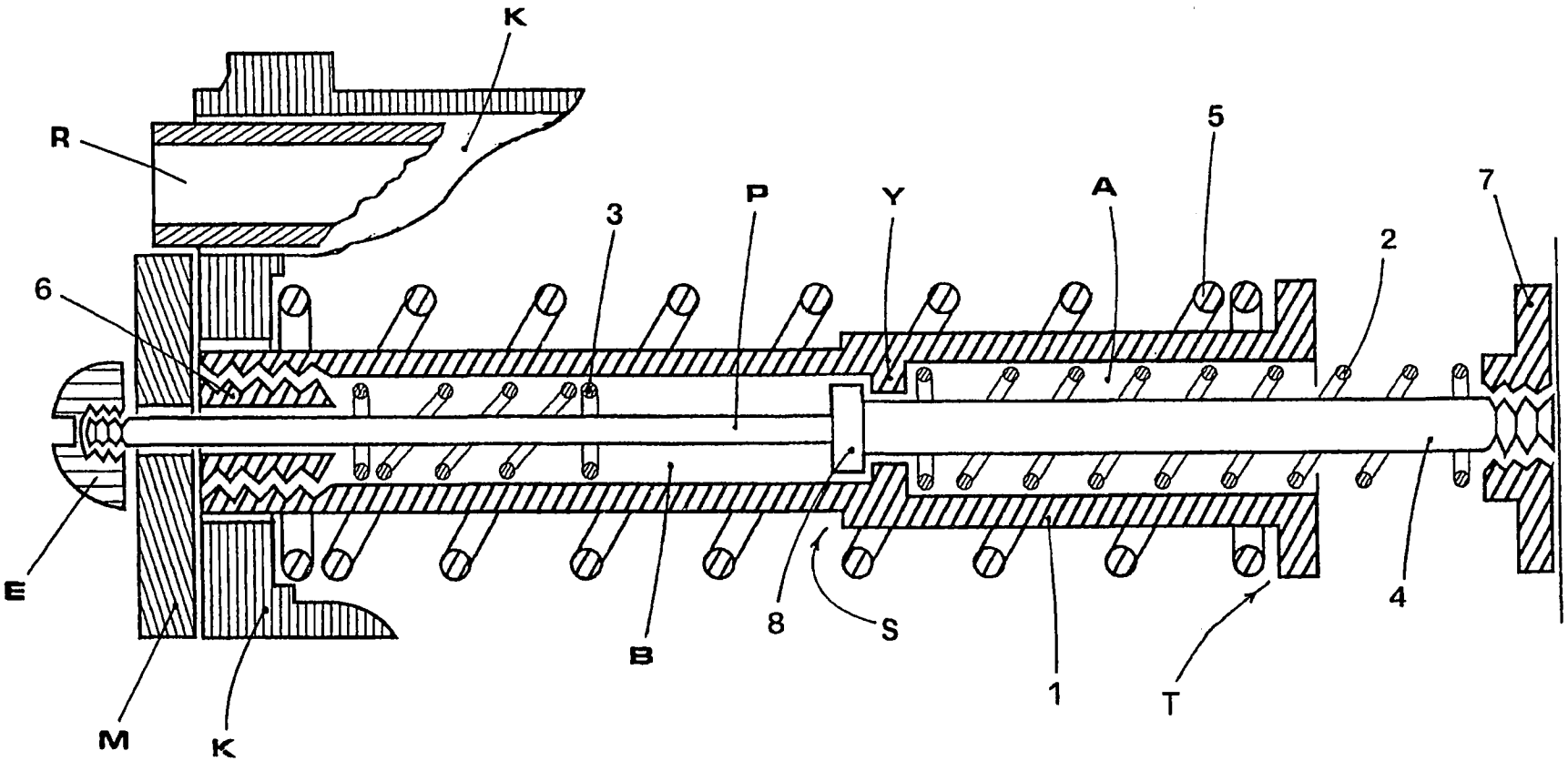
FIG. 1 is a longitudinal sectional view of a first embodiment of a recoil mechanism for a gun according to the invention.
Figure 2:
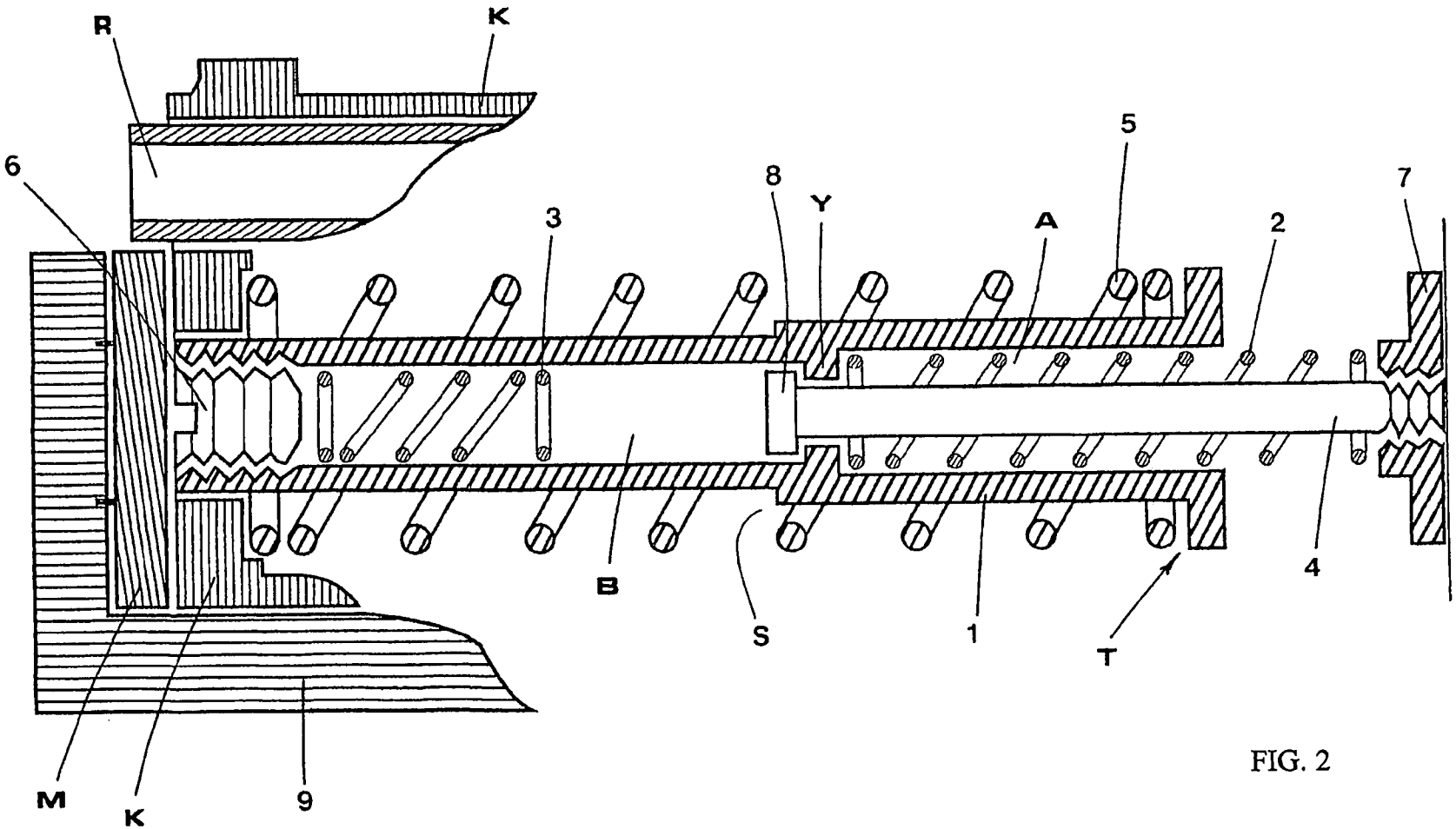
FIG. 2 is a longitudinal sectional view of a second embodiment of the recoil mechanism according to the invention.

Referring to the drawings, FIGS. 1 and 2 illustrate two embodiments of a recoil reduction mechanism for a gun, which both include a cylinder 1 having a large diameter portion that extends into a first spring 5. The cylinder 1 is divided, by a diaphragm Y into two chambers, namely, a first or rear chamber A in the large diameter portion and a second or front chamber B in a small diameter portion of the cylinder 1. In the embodiment of FIG. 1, an axle 4 extends in both chambers A and B, and in the embodiment of FIG. 2 the axle 4 extends only in the first chamber A. A second, small diameter spring 2 is inserted in the first chamber A and a third, small diameter spring 3 is inserted in the second chamber B. A set screw 6 closes one end of chamber B and a rear end of axle 4 that is opposite from chamber B is threaded into a round nut 7 to fix the axle to the frame to which the nut 7 is fixed. This rear end of the axle 4 abuts the frame of the gun and by extension it abuts on the gun's handgrip. In the embodiment of FIG. 1, an extension P of the axle 4 penetrates the set screw 6 and forms part or all of the base for the support of a magnet M, which magnet is locked by a locking nut E threaded to the front end of the axle extension P. Lines of magnetic force of magnet M, attract the front end of the slide K of the gun. In the embodiment of FIG. 2, there is no axle extension but the magnet M is supported on a base 9 of the gun.

In FIG. 1 the recoil mechanism for the gun having a gun-barrel R and the slide K, comprises the large diameter portion of cylinder 1 extending into the first spring 5 which has a rear end that abuts a flange T of the cylinder 1. Spring 5 has a large diameter, and its opposite front end abuts the gun's slide K. The axle 4 is immobilized by its rear end diaphragm Y.

The second spring 2 in chamber A has a front end that abuts diaphragm Y and a rear end that abuts nut 7.

When the springs 5 and 2 are installed in the slide K they are under a minimum compression. The third spring 3 is positioned in chamber B and is trapped by the set screw 6, but since the length of the spring is shorter than chamber's length, the two ends of the spring 3 are at a distance, on the one hand, from the set screw's surface, and on the other hand, from the collar's surface.

The system's function upon firing is as follows.

An instant before the firing of the gun, the spring 2 and the spring 5 are under minimum compression while the spring 3, which is positioned in the chamber B, is under zero compression. The front surface of the slide K under the gun-barrel muzzle and the front surface of the cylinder 1, adjoin the magnet M.

Upon firing the force of the gases generated in the gun-barrel and on the slide, reach a point that overcomes the attraction between the magnet M and the slide K. The slide is then violently set into rearward motion, cutting the lines of force between it and the magnet. This start of the recoil action compresses the spring 5 which pushes the cylinder 1 to the rear. The spring 2, and the magnet's attraction, does not permit the cylinder 1 to move immediately to recoil. Thereby the slide K continues its recoil until it hits a step S between the large and small diameter portions of the cylinder 1.

At step or point S of the cylinder 1, the slide K hits the cylinder 1, and further compression of spring 5 is interrupted. As the gases continue to increase their pressure in the gun-barrel, they get to the point which is critical for the magnet's attraction on the cylinder. Here, the continuous recoil of the slide sets also the cylinder 1 to recoil, and pulls it away from the magnet M.

Upon this phase, the slide K, the spring 5, the cylinder 1 and the set screw 6, recoil as an assembly which compresses the spring 2. Since the axle 4 is not moving towards any direction and since the cylinder 1 recoils, compressing meanwhile the spring 2, the set screw 6, because of the fact that it is screwed in the cylinder 1, reduces the space that contains the spring 3 in the chamber B between the set screw 6 and the collar 8. Up to this moment, wherein the expansion takes place from the bullet's firing, and which expansion acts over the slide K, only two springs function as a retroaction system, since they are positioned successively, to with the first spring 5 and the second spring 2 function as one. Since the slide's recoil is continued with decelerated movement, and with the movement of the cylinder also, and while the spring 2 approaches ⅗ completion, then the third spring 3 abuts on the set screw 6 and the collar 8. The decelerated movement of the slide K and of the cylinder 1 meets the third spring 3 in total inertia, hence the spring 3 absorbs the most of the rest of the slide's recoil energy, before the spring 3 compresses to its maximum extent.

The result is that any further recoil of the slide before it hits the frame and since the gases' expansion is completed, the cylinder 1 and the slide K begin to move in opposite directions, with maximum acceleration, with the further result being improved firing speed of the gun. This is caused by the inertia of spring 3, which acts as an extra powerful suspension against the slide, with direction opposite of the slide's recoil direction, hence minimizing the intensity and the duration of the recoil. The time lag, which is caused by the magnet's presence, causes the gases' maximum expansion and gives bigger initial speed to the bullet, with the consequence of the bullet's firing range increasing. The spring 3 has also positive effect on the slide's axial motion, since the slide's time of roll back to the initial position is faster.

Beyond the magnet's mentioned support method by the axle's extension, another magnet support method is by the use of a base, like the base 9 of FIG. 2. In this case the base 9 is locked on the frame of the gun so as to be immovable and on which base the magnet M is positioned and attracts the cylinder 1 and the slide K. In this case, the extension of the axle doesn't need to be extended to the magnet, as this is depicted in FIG. 2.

The system may function also without a magnet, by using only the mechanical parts, but in this case the bullet will not have longer firing range.

Since the invention being expanded beyond its limits, but by the proper forming of the invention's main parts, like the cylinder's and axle's shape, the springs' resistance force and dimensions, while the spring 3 maintains the specifications of its freedom, the system can fit any gun type.

The invention claimed is:

1. A recoil mechanism for a gun having a frame with a barrel and a slide that is movable rearwardly of the frame and barrel, when the gun is fired, the mechanism comprising:

a cylinder having a rear end with an external flange and an internal diaphragm spaced forwardly of the flange and disposed between a rear chamber and a front chamber both defined in the cylinder;

a round nut fixed to the frame;

an axle extending in the cylinder, the axle having a rear end threaded to the round nut and a collar space forwardly of the rear end and being forward of the diaphragm and trapped in the front chamber by the diaphragm;

a first spring around the cylinder, the first spring having a front end abutting the slide and a rear end abutting the flange;

a second spring extending at least partly in the rear chamber and having a rear end abutting the round nut and a front end abutting the diaphragm;

a third spring in the front chamber, the third spring being shorter in length than the front chamber;

the front chamber having a front entry end and a set screw closing the front entry end of the front chamber;

a magnet magnetically attractively engaged to a front end of the slide and to a front end of the cylinder before the gun is fired; and a support for holding the magnet to the frame comprising one of: an extension of the axle in the front chamber, extending through the set screw and the magnet, and a locking nut threaded to a front end of the extension for fixing the magnet to the axle and frame; and a base fixed to the frame and to the magnet for fixing the magnet to the frame;

the magnet attracting the slide and the cylinder in a forward direction that is opposite to a rearward recoil direction of motion of the slide when the gun is fired; and upon firing of the gun, a force of gases in the barrel acting on the slide to move the slide in the rearward recoil direction, rises to a point which overcomes an attractive force between the magnet and the slide so that the slide starts to move in the rearward recoil direction, and, after a time lag, the slide engages the cylinder causing the cylinder to also move in the rearward recoil direction;

the time lag being selected to allow a maximum expansion of gases from the barrel for propelling a bullet from the barrel while the slide recoils, so that the bullet has improved range;

the third spring functioning in the front chamber to become compressed later during the recoil of the slide to absorb a remainder of recoil energy of the slide, for decelerating any further recoil of the slide, with most recoil energy of the slide being absorbed by a progressive compression of the first spring and the second spring.

2. The recoil mechanism of claim 1, wherein the magnet support comprises the extension of the axle in the front chamber, extending through the set screw and the magnet, and the locking nut threaded to the front end of the extension for fixing the magnet to the axle and frame.

3. The recoil mechanism of claim 1, wherein the magnet support comprises the base fixed to the frame and to the magnet for fixing the magnet to the frame.

* * * * *

UNITED STATES PATENT AND TRADEMARK OFFICE

CERTIFICATE OF CORRECTION

PATENT NO. : 7,380,487 B2
APPLICATION NO. : 10/522271
DATED : June 3, 2008
INVENTOR(S) : Dimitrios Mantas It is certified that error appears in the above-identified patent and that said Letters Patent is hereby corrected as shown below:

Title Page;
On the cover page, correct fields (12) and (76) to read:

(12) United States Patent
Mantas

(76) Inventor: Dimitrios Mantas, 37 Mikras Asias str., Argiroupoli, Athens (GR)

Signed and Sealed this

Nineteenth Day of August, 2008

JON W. DUDAS
*Director of the United States Patent and Trademark Office*